US011510510B2

(12) United States Patent
Bergman

(10) Patent No.: US 11,510,510 B2
(45) **Date of Patent: *Nov. 29, 2022**

(54) PILLOW COVER AND PILLOW

(71) Applicant: FABRICTECH 2000, LLC, Phoenix, AZ (US)

(72) Inventor: Jeffrey Bergman, Scottsdale, AZ (US)

(73) Assignee: FABRICTECH 2000, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/952,230

(22) Filed: Nov. 19, 2020

(65) Prior Publication Data

US 2021/0068560 A1 Mar. 11, 2021

Related U.S. Application Data

(63) Continuation of application No. 16/067,152, filed as application No. PCT/US2016/068324 on Dec. 22, 2016, now Pat. No. 10,966,551.

(60) Provisional application No. 62/274,261, filed on Jan. 2, 2016.

(51) Int. Cl.
*A47G 9/02* (2006.01)
*A47G 9/10* (2006.01)

(52) U.S. Cl.
CPC ..... *A47G 9/0253* (2013.01); *A47G 9/10* (2013.01); *A47G 2009/1018* (2013.01)

(58) Field of Classification Search
CPC ..... A47G 9/0253; A47G 9/10; A47G 9/02; A47G 2009/1018; A47G 9/0238; A47C 7/386
See application file for complete search history.

(56) References Cited

U.S. PATENT DOCUMENTS 3,148,389 A * 9/1964 Lustig ..... A47G 9/10 5/645
3,162,868 A * 12/1964 Cramer ..... A47G 9/0253 5/490
4,754,513 A 7/1988 Rinz
4,924,541 A 5/1990 Inagaki
4,959,880 A * 10/1990 Tesch ..... A47G 9/10 5/636
5,016,303 A 5/1991 Tanaka et al.
5,157,799 A 10/1992 Arid
5,168,590 A 12/1992 O'Sullivan
5,367,731 A 11/1994 O'Sullivan
(Continued)

FOREIGN PATENT DOCUMENTS

EP 0914789 A2 12/1999
GB 2282964 A 4/1995
(Continued)

*Primary Examiner* — Peter M. Cuomo
*Assistant Examiner* — Alison N Labarge
(74) *Attorney, Agent, or Firm* — Renner, Otto, Boisselle & Sklar, LLP

(57) ABSTRACT

The present disclosure provides a pillow cover and pillow having a plurality of compartments. The pillow cover includes a top sheet and a bottom sheet that are connected to define a chamber. An envelope is located on the bottom sheet adjacent to the chamber. A releasable fastener is connected to and located between the top sheet and the bottom sheet. The pillow includes a pad located in the envelope and may include an insert located in the chamber.

20 Claims, 2 Drawing Sheets

(56) References Cited

U.S. PATENT DOCUMENTS

| | | | | |
|---|---|---|---|---|
| 6,230,347 | B1 | 5/2001 | Alexander | |
| 6,691,352 | B2 | 2/2004 | Wang | |
| 8,245,339 | B2 | 8/2012 | Murray et al. | |
| 2004/0154101 | A1 | 8/2004 | DiGirolamo | |
| 2005/0076442 | A1* | 4/2005 | Wassilefky | A47G 9/10 5/636 |
| 2005/0177941 | A1* | 8/2005 | Miller | A47G 9/0253 5/490 |
| 2006/0112487 | A1 | 6/2006 | Taylor | |
| 2006/0123547 | A1 | 6/2006 | Ferber et al. | |
| 2007/0107131 | A1 | 5/2007 | Fux | |
| 2007/0245493 | A1* | 10/2007 | Leifermann | A47G 9/0253 5/636 |
| 2008/0235877 | A1* | 10/2008 | Murray | A47G 9/10 5/640 |
| 2009/0142551 | A1 | 6/2009 | Fox et al. | |
| 2010/0319126 | A1 | 12/2010 | Craib | |
| 2012/0060280 | A1 | 3/2012 | Kelly et al. | |
| 2012/0066837 | A1 | 3/2012 | Thorsen et al. | |
| 2013/0263386 | A1 | 10/2013 | Romero et al. | |
| 2014/0196214 | A1* | 7/2014 | DuPre | A47G 9/0253 5/644 |
| 2016/0316929 | A1 | 11/2016 | Danielson | |
| 2017/0143254 | A1 | 5/2017 | Bell et al. | |

FOREIGN PATENT DOCUMENTS

| | | |
|---|---|---|
| RU | 2004137821 | 5/2005 |
| RU | 148465 | 12/2014 |
| WO | 1997038612 | 10/1997 |

* cited by examiner

PILLOW COVER AND PILLOW

FIELD OF INVENTION

The present disclosure relates generally to a pillow cover and pillow, more particularly to a pillow cover and pillow having a plurality of compartments.

BACKGROUND

Conventional pillow covers or cases are typically constructed from one or two rectangular panels of fabric which are sewn together at some of the edges so as to create an enclosure with one open end. The open end of the pillow cover is typically left open so as to facilitate removing a pillow from, or inserting a pillow into, the pillow cover so that when the pillow is inserted into the pillow cover, the pillow cover surrounds the pillow on three of the four edges of the pillow.

SUMMARY

The present disclosure provides a pillow cover and pillow having a plurality of compartments. The pillow cover includes a top sheet and a bottom sheet that are connected to define a chamber. An envelope is located on the bottom sheet adjacent to the chamber. A releasable fastener is connected to and located between the top sheet and the bottom sheet. The pillow includes a pad located in the envelope and may include an insert located in the chamber.

In accordance with one aspect of the present disclosure, a pillow cover includes: a top sheet and a bottom sheet connected to define a chamber; an envelope located on the bottom sheet adjacent to the chamber; and a releasable fastener connected to and located between the top sheet and the bottom sheet.

In one embodiment, the pillow includes a plurality of compartments located on the top sheet opposite the chamber. The plurality of compartments may be arranged in a grid pattern.

In another embodiment, each of the compartments is an elongated channel.

In accordance with another aspect of the present disclosure, a pillow includes: a top sheet and a bottom sheet connected to define a chamber; an envelope located on the bottom sheet adjacent to the chamber; a pad placed in the envelope; and a releasable fastener connected to and located between the top sheet and the bottom sheet.

In one embodiment, a plurality of compartments is located on the top sheet opposite the chamber. The plurality of compartments may be arranged in a grid pattern.

In another embodiment, each of the compartments is an elongated channel.

In another embodiment, the pad includes gel covered visco foam, visco foam, or latex.

In another embodiment, the pad includes a cover filled with fiber, down, chipped memory foam, or a mixture of two or more thereof.

In another embodiment, the releasable fastener includes a zipper or hook and loop fastener.

In accordance with yet another aspect of the present disclosure, a pillow includes: a top sheet and a bottom sheet connected to define a chamber; an insert placed in the chamber; a plurality of compartments located on the top sheet opposite the chamber; an envelope located on the bottom sheet adjacent to the chamber; a pad placed in the envelope; and a releasable fastener connected to and located between the top sheet and the bottom sheet.

In one embodiment, the plurality of compartments is arranged in a grid pattern.

In another embodiment, each of the compartments is an elongated channel.

In another embodiment, the insert includes gel covered visco foam, visco foam, or latex.

In another embodiment, the insert includes a cover filled with fiber, down, chipped memory foam, or a mixture of two or more thereof.

In another embodiment, the releasable fastener includes a zipper or hood and loop fastener.

DETAILED DESCRIPTION

Figure 1:
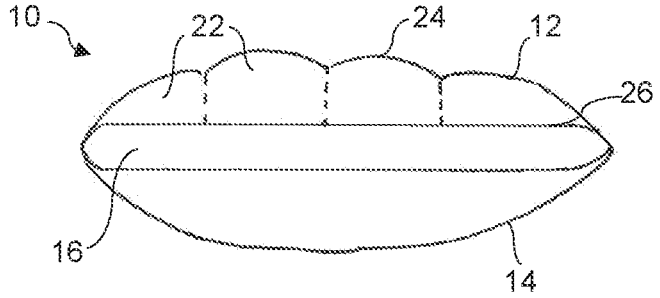
FIG. 1 is a side view of an exemplary pillow cover according the disclosure.

In the description that follows, like components have been given the same reference numerals, regardless of whether they are shown in different embodiments. To illustrate an embodiment(s) of the present disclosure in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

An exemplary pillow cover includes a top sheet and a bottom sheet that are connected to define a chamber. The plurality of compartments is located on the top sheet opposite the chamber. An envelope is located on the bottom sheet adjacent to the chamber. A releasable fastener is connected to and located between the top sheet and the bottom sheet. The pillow includes a pad located in the envelope and may include an insert located in the chamber.

Figure 2:
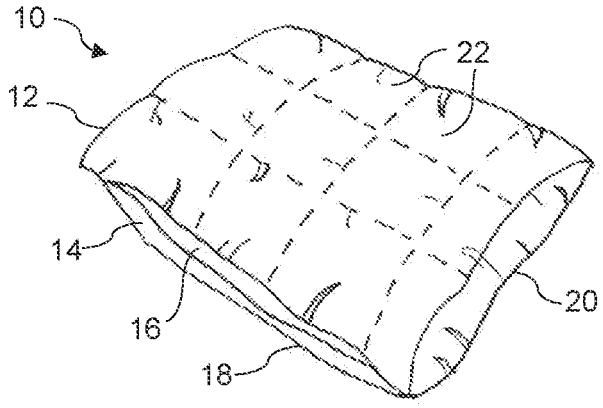
FIG. 2 is a top oblique view of the cover of FIG. 1
Figure 3:
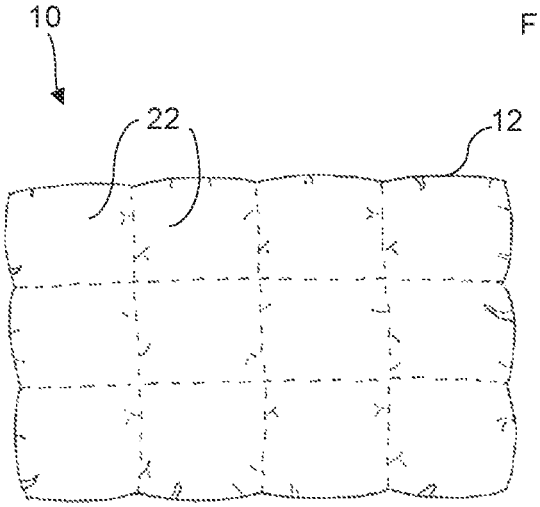
FIG. 3 is a top plan view of the cover of FIG. 1, wherein the compartments are arranged in a grid pattern.

Referring now in detail to the drawings, and initially to FIGS. 1-3, a pillow cover is shown at 10. The depicted cover 10 includes a top sheet 12 and a bottom sheet 14. The top sheet 12 and bottom sheet 14 may be made of cotton, linen, silk, polyester, wool, nylon, rayon, lyocell, lycra, or a mixture of two or more thereof. The thread count of the top sheet 12 and bottom sheet 14 may be in the range of about 100 to 1000, or in another example, in the range of about 250 to 750, or in another example, in the range of about 400 to 500. In one embodiment, the top sheet 12 and bottom sheet 14 are made of a 400 thread count, 60% lyocell and 40% nylon.

As shown, the sheets 12 and 14 have a generally rectangular shape with a pair of long sides 18 and a pair of short sides 20. The sheets 12 and 14 may be connected along one of the long sides 18, one of the short sides 20, the pair of long sides 18, the pair of short sides 20, or a combination thereof. The top sheet 12 and bottom sheet 14 may be connected with stiches of thread or may be constructed of a single piece of fabric folded to form congruent rectangular top sheet 12 and bottom sheet 14.

The sheets 12 and 14 may have a length in the range of about 10 inches to 36 inches, or in another example, in the range of about 15 inches to 25 inches, or in another example, in the range of about 20 inches to 25 inches. The sheets 12 and 14 may have a width in the range of 5 inches to 26 inches, or in another example, in the range of 10 inches to 20 inches, or in another example, in the range of 15 inches to 20 inches. In one embodiment, the sheets 12 and 14 have a length of 24 inches and a width of 16 inches.

The top sheet 12 and the bottom sheet 14 are connected to form chamber 16. Though shown along one of the long sides 18, the chamber 16 may be located along one of the short sides 20. The chamber 16 may include a lining. The lining may be made of cotton, linen, silk, polyester, wool, nylon, rayon, lyocell, lycra, taffeta, or a mixture of two or more thereof.

A plurality of compartments 22 is located on the top sheet 12 opposite the chamber 16. The top sheet 12 may be two panels of fabric 24 and 26. The compartments 22 may be formed by stitching at predetermined locations along the two panels of fabric 24 and 26 to form cavities and filling the cavities with fiber filling. The stitching of the compartments 22 prevents the fiber filling in one compartment from entering another compartment. The fiber filling may be made of foam, polyester, cotton, down, or a mixture of two or more thereof.

The plurality of compartments 22 may be arranged along the top sheet 12 in a grid pattern, meaning each compartment may have a generally square shape and the plurality of compartments 22 may extend in both the length and width directions of the top sheet 12. In a grid pattern, the number of compartments 22 extending in the length by the width direction may be one compartment by one compartment, or in another example, two compartments by one compartment, or in another example, three compartments by one compartment, or in another example, four compartments by one compartment, or in another example, five compartments by one compartment, or in another example, three compartments by two compartments, or in another example, four compartments by three compartments, or in another example, five compartments by four compartments, or in another example, four compartments by two compartments, or in another example, five compartments by three compartments, or in another example two compartments by two compartments, or in another example, three compartments by three compartments, or in another example, four compartments by four compartments, or in another example, five compartments by five compartments.

Each compartment 22 may have a width in the range of about 1 inch to 10 inches, or in another example, in the range of about 3 inches to 8 inches, or in another example, in the range of about 5 inches to 6 inches. Each compartment 22 may have a length in the range of about 2 inches to 12 inches, or in another example, in the range of 4 inches to 8 inches, or in another example, in the range of 5 inches to 7 inches. Each compartment 22 may have a height in the range of about 0.25 inch to 4 inches, or in another example, in the range of about 0.5 inch to 1.5 inches, or in another example, in the range of 0.75 inch to 1.25 inches. In one embodiment, each compartment 22 has a width of 5.5 inches, a length of 6 inches, and a height of 1 inch. Each compartment 22 may be equal or different in size as compared to other compartments 22.

Figure 4:
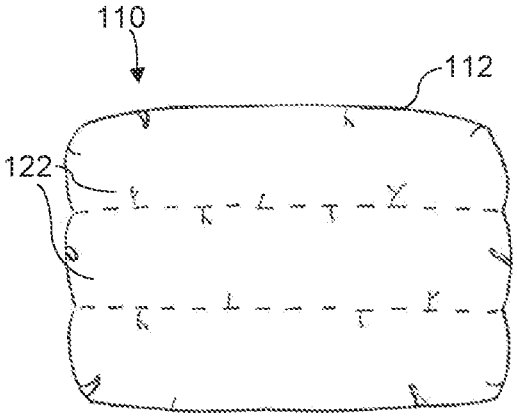
FIG. 4 is a top plan view of an embodiment of the cover of FIG. 1, wherein each of the compartments is an elongated channel.

Referring to FIG. 4, each of the compartments 122 of pillow cover 110 may form an elongated channel that extends along the length of the top sheet 112. The compartments may have a generally rectangular shape. When the compartments 122 form elongated channels, there may be at least 2 compartments, or in another example, at least 3 compartments, or in another example, at least 4 compartments, or in another example, at least 5 compartments.

Each compartment 122 may have a width in the range of about 3 inches to 13 inches, or in another example, in the range of about 5 inches to 10 inches, or in another example in the range of about 3 inches to 6 inches. Each compartment 122 may have a length in the range of about 10 inches to 36 inches, or in another example, in the range of about 15 inches to 30 inches, or in another example, in the range of about 20 inches to 25 inches. Each compartment 122 may have a height in the range of about 0.25 inch to 4 inches, or in another example, in the range of about 0.5 inch to 1.5 inches, or in another example, in the range of 0.75 inch to 1.25 inches.

The amount of filling in the compartments 22 (FIG. 3) or the compartments 122 (FIG. 4) may be adjusted to alter the firmness or compressibility of the compartments. Each compartment may by compressible in the range of about 1% to 10% by volume, or in another example, in the range of about 1% to 5% by volume, or in another example, in the range of about 10% to 25% by volume, or in another example, in the range of about 15% to 20% by volume, or in another example, in the range of about 20% to 30% by volume, or in another example, in the range of about 30% to 40% by volume, or in another example, in the range of about 40% to 50% by volume.

Figure 5:
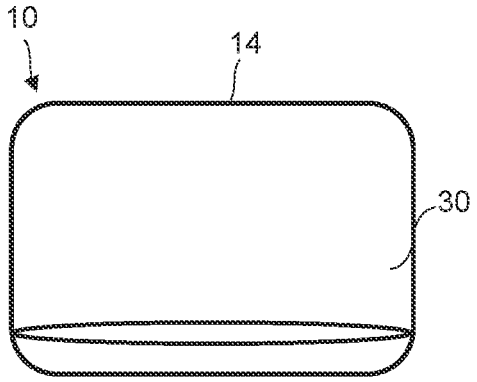
FIG. 5 is a top plan view the cover of FIG. 1 with the top sheet removed.

Referring to FIG. 5, an envelope 30 on the bottom sheet 14 of pillow cover 10 is located adjacent to the chamber 16 (FIG. 1). The envelope 30 has a generally rectangular shape and is connected to the bottom sheet 14 along three sides with an opening along the unconnected side. The envelope 30 may extend the entire or only a portion of the length and width of the bottom sheet 14. The opening of the envelope 30 may be aligned with the opening of chamber 16 (FIG. 1). The envelope 30 may be made of made of cotton, linen, silk, polyester, wool, nylon, rayon, lyocell, lycra, taffeta, or a mixture of two or more thereof. In one embodiment, the envelope 30 is made of a polyester mesh knitted tricot.

Figure 6:
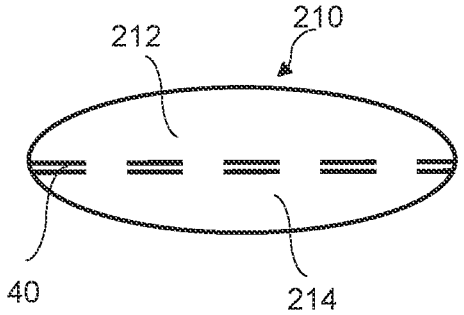
FIG. 6 is a side plan view of an embodiment of the cover of FIG. 1, wherein a releasable fastener is connected to and located between the top sheet and the bottom sheet.

Referring to FIG. 6, a releasable fastener 40 of pillow cover 210 is connected to and located between the top sheet 212 and the bottom sheet 214. The releasable fastener 40 closes chamber 16 (FIG. 1). The releasable fastener 40 may be made of a zipper or hook and loop fasteners, such as Velcro®. The releasable fastener 40 may extend along the length of the top sheet 212 and the bottom sheet 214 or along the width of the top sheet 212 and the bottom sheet 214. The releasable fastener 40 may extend the entire or only a portion of the length and width of the top sheet 212 and the bottom sheet 214.

Figure 7:
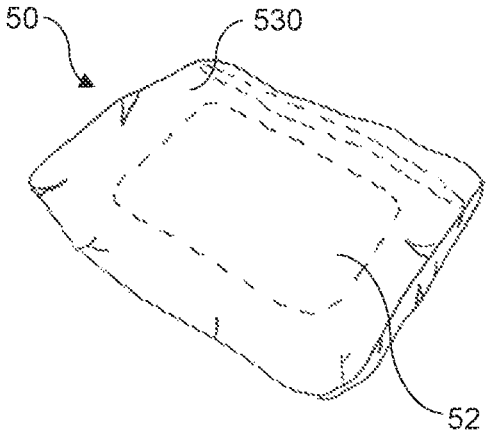
FIG. 7 is a bottom oblique view of an exemplary pillow according to the disclosure.

Referring to FIG. 7, a pillow is shown at 50. The depicted pillow 50 has similar features as the pillow cover 10 of FIGS. 1, 2, 3, and 5. The pillow 50 includes a pad 52 placed inside the envelope 530. The pad 52 has a generally rectangular shape. The pad 52 may extend the entire or only a portion of the length and width of envelope 530. The pad 52 may be made of gel covered visco foam, visco foam, or latex. The pad 52 may be a cover (e.g. cotton, linen, silk, polyester, wool, nylon, rayon) filled with fiber, down, chipped memory foam, or a mixture of two or more thereof.

Figure 8:
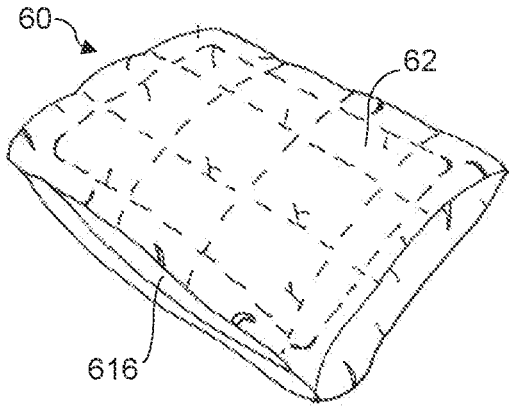
FIG. 8 is a top oblique view of another exemplary pillow according to the disclosure.

Referring to FIG. 8, another embodiment of a pillow is shown at 60. The depicted pillow 60 has similar features as the pillow cover 10 of FIGS. 1, 2, 3, and 5 and may include a pad 52 as shown in FIG. 7. The pillow 60 includes an insert 62 placed in the chamber 616. The insert 62 has a generally rectangular shape. The insert 62 may extend the entire or only a portion of the length and width of chamber 616. The insert 62 may be made of gel covered visco foam, visco foam, or latex. The insert 62 may be a cover (e.g. cotton, linen, silk, polyester, wool, nylon, rayon) filled with fiber, down, chipped memory foam, or a mixture of two or more thereof.

The present disclosure provides a pillow cover and pillow having a plurality of compartments. The pillow cover 10 includes a top sheet 12 and a bottom sheet 14 that are connected to define a chamber 16. The plurality of compartments 22 is located on the top sheet opposite the chamber 16. An envelope 30 is located on the bottom sheet 14 adjacent to the chamber. A releasable fastener 40 is connected to and located between the top sheet 12 and the bottom sheet 14. The pillow 50 includes a pad 52 located in the envelope 30 and may include an insert 62 located in the chamber 16.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A multi-purpose pillow comprising:

a rectangular sheet arrangement including a rectangular shaped top sheet and a rectangular shaped bottom sheet stitched together along three edges to define an inner chamber having an opening on a fourth edge;

a removable pillow insert received in the rectangular sheet arrangement and contained within the inner chamber for adjusting a loft of the pillow, the removable pillow insert extending across at least a portion of a width and at least a portion of a length of the inner chamber and comprising a cover made with at least one of cotton, silk, polyester, wool, nylon, rayon, or a mixture of two or more thereof, the cover being filled with fiber down, chipped memory foam, or a mixture of two or more thereof;

one or more fiber-filled compartments arranged on the rectangular shaped top sheet such that the one or more fiber-filled compartments are on a first side of the pillow with respect to the inner chamber;

an envelope connected to the bottom sheet such that the envelope is on a second side of the pillow, opposite the first side with respect to the inner chamber, the envelope having an opening distinct from the opening of the inner chamber;

a removable foam pad contained within the envelope; and a releasable fastener connecting the top sheet and the bottom sheet at the opening of the inner chamber.

2. The multi-purpose pillow of claim 1, wherein the removable foam pad comprises gel covered visco foam, visco foam, chipped memory foam, or latex.

3. The multi-purpose pillow of claim 1, wherein the releasable fastener comprises a zipper.

4. The multi-purpose pillow of claim 1, wherein the releasable fastener comprises a hook and loop fastener.

5. The multi-purpose pillow of claim 1, wherein the removable pillow insert is configured to extend across an entire width and an entire length of the inner chamber.

6. The multi-purpose pillow of claim 1, wherein the one or more fiber-filled compartments are filled with a fiber-filling made of at least one of foam, polyester, cotton, down, or a mixture of two or more thereof.

7. The multi-purpose pillow of claim 1, wherein the rectangular shaped top sheet includes a first panel of fabric and a second panel of fabric connected together at predetermined locations to form the one or more fiber-filled compartments.

8. The multi-purpose pillow of claim 1, wherein each of the one or more fiber-filled compartments are compressible in a range of 1% to 50% 8by volume.

9. A multi-purpose pillow comprising:

a rectangular sheet arrangement including a rectangular shaped top sheet and a rectangular shaped bottom sheet stitched together along three edges to define an inner chamber having an opening on a fourth edge;

a removable pillow insert contained within the inner chamber to adjust a loft of the pillow, the removable pillow insert being filled with at least one of fiber, down, foam, or a mixture of two or more thereof;

one or more fiber-filled compartments arranged on the rectangular shaped top sheet such that the one or more fiber-filled compartments are on a first side of the pillow with respect to the inner chamber;

an envelope connected to the bottom sheet such that the envelope is on a second side of the pillow, opposite the first side with respect to the inner chamber, the envelope having an opening distinct from the opening of the inner chamber;

a removable foam pad contained within the envelope; and a releasable fastener connecting the top sheet and the bottom sheet at the opening of the inner chamber.

10. The multi-purpose pillow of claim 9, wherein the one or more fiber-filled compartments form one or more elongated channels.

11. The multi-purpose pillow of claim 9, wherein the one or more fiber-filled compartments include two or more fiber-filled compartments.

12. The multi-purpose pillowof claim 11, wherein the two or more fiber-filled compartments are equally-sized.

13. The multi-purpose pillow of claim 11, wherein the two or more fiber-filled compartments are arranged in a grid pattern.

14. The multi-purpose pillow of claim 9, wherein the opening of the envelope is on an edge of the envelope aligned with the fourth edge of the inner chamber.

15. The multi-purpose pillow of claim 9, wherein the removable foam pad comprises gel covered visco foam, visco foam, chipped memory foam, or latex.

16. The mufti-purpose pillow of claim 9, wherein the releasable fastener comprises a zipper or a hook and loop fastener.

17. The mufti-purpose pillow of claim 9, wherein the removable pillow insert is configured to extend across an entire width and an entire length of the inner chamber.

18. The mufti-purpose pillow of claim 9, wherein the one or more fiber-filled compartments are filled with a fiber-filling made of at least one of foam, polyester, cotton, down, or a mixture of two or more thereof.

19. The multi-purpose pillow of claim 9, wherein the rectangular shaped top sheet includes a first panel of fabric and a second panel of fabric connected together at predetermined locations to form the one or more fiber-filled compartments.

20. The multi-purpose pillow of claim 9, wherein each of the one or more fiber-filled compartments are compressible in a range of 1% to 50% by volume.

* * * * *